US010934140B2

(12) United States Patent
Konijn

(10) Patent No.: US 10,934,140 B2
(45) Date of Patent: Mar. 2, 2021

(54) TOWER CRANE

(71) Applicant: LIEBHERR-WERK BIBERACH GMBH, Biberach an der Riß (DE)

(72) Inventor: Eric Konijn, Singapore (SG)

(73) Assignee: LIEBHERR WERK BIBERACH GMBH, Biberach an der Riss (DE)

( * ) Notice: Subject to any disclaimer, the term of this patent is extended or adjusted under 35 U.S.C. 154(b) by 38 days.

(21) Appl. No.: 16/333,497

(22) PCT Filed: Sep. 12, 2017

(86) PCT No.: PCT/EP2017/001077
§ 371 (c)(1),
(2) Date: Apr. 23, 2019

(87) PCT Pub. No.: WO2018/050278
PCT Pub. Date: Mar. 22, 2018

(65) Prior Publication Data

US 2019/0256330 A1 Aug. 22, 2019

(30) Foreign Application Priority Data

Sep. 15, 2016 (DE) ..... 10 2016 011 179.8

(51) Int. Cl.

| | |
|---|---|
| ***B66C 23/28*** | (2006.01) |
| ***B66C 23/00*** | (2006.01) |
| ***B66C 23/76*** | (2006.01) |
| ***B66C 23/72*** | (2006.01) |

(52) U.S. Cl.
CPC ..... *B66C 23/283* (2013.01); *B66C 23/54* (2013.01); *B66C 23/72* (2013.01); *B66C 23/76* (2013.01)

(58) Field of Classification Search
CPC ..... B66C 23/06; B66C 23/16; B66C 23/163; B66C 23/18; B66C 23/26; B66C 23/28; B66C 23/283; B66C 23/54; B66C 23/62; B66C 23/72; B66C 23/74; B66C 23/76
See application file for complete search history.

(56) References Cited

U.S. PATENT DOCUMENTS

2003/0183594 A1* 10/2003 Torres Martinez ..... B66C 23/32 212/196

FOREIGN PATENT DOCUMENTS

| | | | | |
|---|---|---|---|---|
| BE | 848626 A | | 3/1977 | |
| CH | 386075 A | * | 12/1964 | ..... B66C 23/283 |
| CH | 400489 A | * | 10/1965 | ..... B66C 23/283 |
| DE | 1159607 B | | 12/1963 | |
| DE | 1172821 B | * | 6/1964 | ..... B66C 23/283 |
| DE | 9010221 U1 | | 11/1990 | |

(Continued)

OTHER PUBLICATIONS

Machine Translation FR 1,192,705 (Year: 1959).*

(Continued)

*Primary Examiner* — Michael R Mansen
*Assistant Examiner* — Juan J Campos, Jr.
(74) *Attorney, Agent, or Firm* — McCoy Russell LLP

(57) ABSTRACT

The present invention relates to a tower crane, in particular a revolving tower crane, comprising a crane tower composed of a plurality of tower pieces, a main boom arranged at the tower tip, and a counter-boom, wherein at least one main hoist rope is guided over the main boom to take up the load and at least one counter-boom hoist rope is guided over the counter-boom to take up a balance weight.

18 Claims, 7 Drawing Sheets

(56) References Cited

FOREIGN PATENT DOCUMENTS

| | | | | | |
|---|---|---|---|---|---|
| DE | 102015016279 | A1 | | 6/2016 | |
| EP | 0516938 | A1 | | 12/1992 | |
| FR | 1192705 | A | * | 10/1959 | ..... B66C 23/283 |
| FR | 1306447 | A | * | 10/1962 | ..... B66C 23/283 |
| FR | 1470368 | A | * | 2/1967 | ..... B66C 9/14 |
| FR | 2009526 | A1 | * | 2/1970 | ..... B66C 23/283 |
| JP | S4836509 | B1 | | 11/1973 | |

OTHER PUBLICATIONS

ISA European Patent Office, International Search Report Issued in Application No. PCT/EP2017/001077, dated Jan. 25, 2018, WIPO, 8 pages.

* cited by examiner

TOWER CRANE

CROSS-REFERENCE TO RELATED APPLICATION

The present application is a U.S. National Phase of International Patent Application Serial No. PCT/EP2017/001077 entitled "TOWER CRANE" filed on Sep. 12, 2017. International Patent Application Serial No. PCT/EP2017/001077 claims priority to German Patent Application No. 10 2016 011 179.8, filed on Sep. 15, 2016. The entire contents of each of the above-cited applications are hereby incorporated by reference for all purposes.

TECHNICAL FIELD

The invention relates to a tower crane, in particular to a revolving tower crane, having a crane tower composed of a plurality of tower pieces, having a main boom arranged at the crane tower tip, and having a counter-boom.

BACKGROUND AND SUMMARY

Tower cranes are frequently used for particularly high hoisting heights and heavy payloads. The setting up of wind power stations in particular requires large hoisting heights and high payloads. It is desirable in this context always to install the hubs of the wind power stations at ever greater heights. The maximum possible assembly height is, however, limited by the available hoisting gear.

Current tower cranes can admittedly currently still satisfy the demands made, but will already reach their technical limits in the near future. Current designs comprise a crane tower that is composed of lattice pieces and to whose tower tip a boom system is fastened. The main boom can be designed as fixed or as luffable. A rigid counter-boom is provided to ballast the crane and the required ballast plates are suspended at its free end in dependence on the payload.

The object of the present invention comprises demonstrating a new crane structure that permits larger payloads and also greater hoisting heights, with such a crane, however, not being connected to the construction where possible and with its transport and assembly also being able to be carried out as easily and as fast as possible.

This object is achieved by a revolving tower crane, in particular a revolving tower crane, comprising a crane tower composed of a plurality of tower pieces, a main boom arranged at the tower tip, and a counter-boom, wherein at least one main hoist rope is guided over the main boom to take up a load and at least one counter-boom hoist rope is guided over the counter-boom to take up a balance weight. Advantageous embodiments of the tower crane are the subject of the subordinate claims dependent on the main claim.

A tower crane, in particular a revolving tower crane, particularly preferably a top slewer, is therefore proposed that has a crane tower composed of a plurality of tower pieces and at whose tower tip a main boom and a counter-boom are arranged. In accordance with the invention, the innovative tower crane is characterized in that a main hoist rope is guided at the main boom for the load take-up and at least one counter-boom hoist rope is guided over the counter-boom to take up the balance weight. A load to be hoisted is typically taken up by the main hoist rope.

The counter-boom hoist rope of the counter-boom is used to ballast the crane with the required balance ballast or counter-ballast for the desired load hoist. This preferably takes place by taking up typical counter-ballast elements or plates that now no longer have to be installed at the counter-boom in a laborious manner, but can rather be comfortably taken up from the base by means of the counter-boom hoist rope. In addition, the center of gravity of the counter-ballast can be positioned a lot lower in crane operation due to the design in accordance with the invention, which inter alia brings about substantial advantages in the dimensioning of the crane so that ultimately higher hoist heights and larger payloads can be achieved.

The balance weight that is to be hoisted at the counter-boom has to be adapted by the load hoist. It applies in an ideal manner to the dimensioning of the balance weight that the load of the main boom taken up multiplied by the distance of the load take-up point (crane hook of the main boom) from the tower center corresponds to the product of the balance weight and the distance of the take-up point (crane hook of the counter-boom) from the tower center.

The take-up of the counterweight by means of the counter-boom hoist rope preferably takes place via a lifting hook; however, alternative load take-up means are likewise conceivable.

The crane tower can ideally be designed as a top-slewer. The crane tower can be supported at the ground by means of an undercarriage or by means of a connection piece set in concrete.

It is particularly advantageous with the crane in accordance with the invention if at least the counter-boom is arranged in a luffable manner at the tower tip of the crane. A luffable support of the main boom at the crane tower is equally conceivable. The corresponding hoist height can be variably adapted by the luffable main boom or the distance of the load taken up from the crane tower can be varied. There is likewise the possibility by means of the luffable counter-boom of a flexible setting of the distance of the counter-ballast weight taken up with respect to the crane tower so that a particularly flexible ballasting possibility for the total tower crane results.

In accordance with a particularly preferred embodiment of the invention, the crane tower comprises at least one climbing section that permits extension or shortening of the crane tower taking place in crane operation. One or more additional tower pieces can be attached to or removed from the tower tip by means of the climbing section in operation, whereby the crane tower can grow together with the construction progress. It is particularly preferred in this case if at least the counter-boom or the main boom, preferably both booms, are luffably supported at the climbing section.

In accordance with a particularly preferred embodiment of the invention, the climbing section represents the tower tip of the crane tower in crane operation. It is conceivable for the implementation of a top slewer that the climbing section is rotatable about a vertical axis of rotation with respect to the other tower pieces of the crane tower. A corresponding rotational support in the climbing section enables a rotational movement with respect to the tower over the total length of the tower.

One or more consoles can be installed laterally at the climbing section to take up the main boom and/or the counter-boom. An installation of one or more consoles at the front side and rear side of the tower crane or of the climbing section, i.e. at the side faces of the climbing section disposed transversely to the luffing plane, is particularly preferred.

Such consoles can furthermore be configured to take up one or more drive units of the crane. Corresponding drive units serve, for example, to drive the hoist winches installed at the boom system and/or to drive the slewing gear and/or the climb drive of the climbing section. Additionally or alternatively, one or more switch cabinets can be installed in at least one of the consoles to control the installed hydraulics or electrics of the crane. The accommodation of one or more hydraulic tanks within the consoles is also conceivable.

The climbing section is ideally extendable in the vertical direction by means of a hydraulic drive, particularly preferably by means of a hydraulic cylinder. It is advantageous in this case to provide one or more cut-outs and/or abutments at one or more tower pieces of the tower to flexibly support the hydraulic cylinder at the construction structure depending on the tower height. Ideally, one or more abutments are provided per tower piece so that the composed tower has a plurality of abutments spaced apart, preferably equally, in the axial direction.

The main boom and/or the counter-boom can be anchored via separate guys. The luffing angle of the booms can preferably be set via the respective guying rope system that is ideally actuable by means of a winch. It is further advantageous if at least two guying frames are provided at the climbing section, with each guying frame being connected to the corresponding guying rope system of the main boom or of the counter-boom. Ideally, a guying frame is connected to a guying rope system of the main boom, whereas the second guying frame is connected to a guying rope system of the counter-boom. At least one guying frame, preferably all the guying frames is/are pivotably supported at the consoles of the climbing section. The guying frame of the main boom is preferably pivotably supported at the console taking up the main boom. The same applies to the further guying frame of the counter-boom that is pivotably fastened to the console for the support of the counter-boom.

The guying frames can be connected to one another via a length-adjustable connection, in particular a rope arrangement. The angle of the respective guying frames can be set by the length-adjustable connection. The length adjustment of the connecting rope arrangement of the guying frames can preferably take place via a hoist winch. Alternative adjustment drives are, however, conceivable.

In a particularly advantageous embodiment of the invention, the main boom and/or the counter-boom can be downwardly luffable such that they laterally contact the tower crane almost in parallel. This preferably takes place by letting out the respective guying rope systems and by a corresponding elongation of the rope arrangement connecting the guying frames. Both booms are thereby pivoted downward in the direction of the crane tower until they contact it almost in parallel. This crane state represents a particularly advantageous out-of-operation position of the crane to reduce its area exposed to wind as far as possible. This makes it possible to leave the crane set up even at higher wind speeds.

The putting into the out-of-operation position preferably takes place in that initially the two guying rope systems are let out so much until the main boom and the counter-boom are luffed down as flat as possible, i.e. both booms are in an almost horizontal position. In this state, the bolt connection between the guying frames is released and the rope arrangement is correspondingly extended so that the two booms pivot downward in the direction of the crane tower.

In accordance with a further advantageous embodiment of the invention, at least one auxiliary boom can be arranged at the counter-boom; an additional auxiliary boom is preferably pivotably installed at the outer tip of the counter-boom. It is further advantageous in this case if at least one auxiliary hoist rope is guided over the auxiliary boom. It is alternatively conceivable that the hoist rope of the counter-boom is temporarily guided over the auxiliary boom for the use thereof. However, the embodiment with a separate auxiliary hoist rope for the auxiliary boom is preferred.

The auxiliary boom ideally serves to take up one or more tower pieces to be able to introduce it or them into the climb section for the climbing process of the crane tower. It is particularly expedient in this case if the counter-boom and the auxiliary boom are pivotable such that the auxiliary hoist rope or the tower piece taken up by it can be moved into a position above the climbing section. For this purpose, the counter boom is ideally set almost perpendicular and the auxiliary boom is pivoted over the tower tip.

Provision can be made in a further optional embodiment of the crane that at least one collar is installed about the crane tower. The at least one collar provides corresponding installation points for the connection of one or more guys that extend, starting from the collar, in the direction of any fixing points at the crane base or at a crane undercarriage. The maximum hoist height or crane tower length can be increased by this additional guying of the crane tower. The guying used preferably at least partially comprises rope material and/or sheet metal material.

BRIEF DESCRIPTION OF THE FIGURES

Advantageous embodiments of the invention will be explained in more detail in the following with reference to an embodiment shown in the Figures.

There are shown.

DETAILED DESCRIPTION

The crane in accordance with the invention comprises a crane tower 1 composed of a plurality of tower pieces 11. The crane tower 1 is supported at the ground by means of an undercarriage 2. Alternatively to the undercarriage, a connection piece (not shown) cemented in could also be used.

Figure 1:
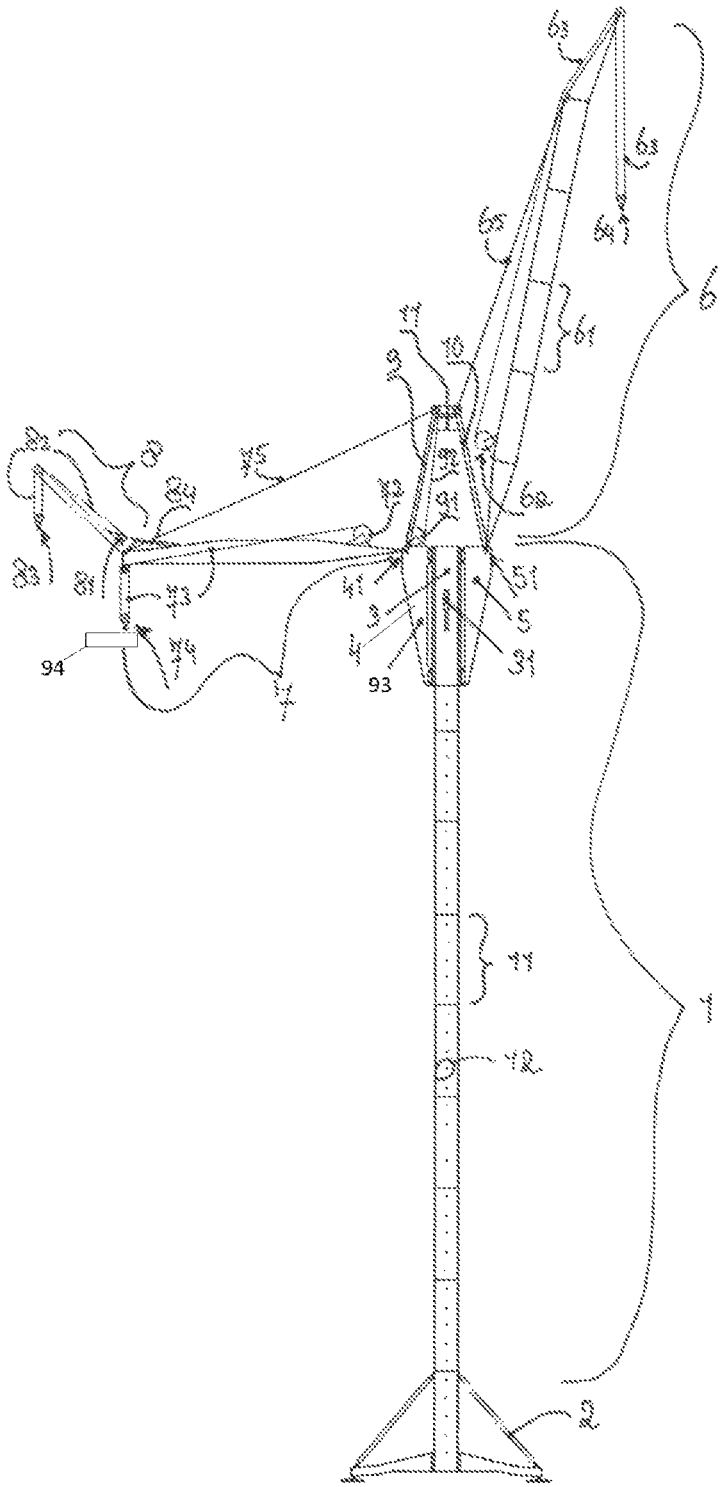
FIG. 1: a sketched side view of the crane revolving tower in accordance with the invention.

The basic design of the crane should first be described with reference to FIG. 1. A rotatable and climbable climbing section 3 is installed around the tower 1 at the tower tip. The climbing section 3 is displaceable vertically along the tower 1 by means of one or more hydraulic cylinders 31. The hydraulic cylinder 31 is supported in abutments 12 of the tower 1 suitable for this purpose. The crane becomes a top slewer by means of the rotatable climbing section.

Two consoles 4, 5 are installed at both sides at the climbing section 3 and the drive units, switch cabinets, and hydraulic tanks of the crane are installed in them. The console 5 fastened to the front side of the climbing section 3 takes up the main boom 6, with the latter being luffably supported at the console 5 at the supporting point 51. The main boom 6 is made up of a plurality of boom pieces 61 and accordingly has a variable length. A hoist winch 62 is installed at the main boom 6 to store and actuate the hoist rope 63 to which the lifting hook 64 to take up the load is lashed.

The counter-boom 7 is pivotably supported at the supporting point 93 at the console 4 that is installed at the rear side of the climbing section 3. A hoist winch 72 on which the further hoist rope 73 is stored is likewise installed at the counter-boom 7. The lifting hook 74 is actuated by the hoist rope 73. The counter-boom 7 serves the balance of the load taken up by the main boom 6. A laborious installation of the ballast weight at the counter-boom becomes superfluous in this manner; the ballast elements 94 can instead be simply taken up via the crane hook 74. This method allows a lower center of gravity of the total crane.

The balance weight that is to be hoisted at the counter-boom 7 has to be adapted by the hoist.

Load at the main boom×Distance(main boom lifting hook/tower center)=Load at the counter boom×Distance(counter-boom lifting hook/tower center).

An auxiliary boom 8 that is pivotably supported at the tip of the counter-boom 7 is furthermore installed at the counter-boom 7. The auxiliary boom 8 likewise has its own hoist winch 81 with hoist rope 82 and lifting hook 83. In addition, the auxiliary boom 8 is hydraulically adjustable with respect to the counter-boom 7 via the cylinder 84.

The auxiliary boom 8 is inter alia used during "climbing", which will be looked at below during the description of the climbing procedure.

Guying frames 9, 10 are furthermore pivotably installed at both consoles 4, 5. The frames 9, 10 are connected by means of a connection 11 and serve to move the booms 6, 7 into an "out-of-operation position". This procedure will also be described in detail below. The frames 9, 10 are movable by means of a hoist winch 91 and a hoist rope 92, i.e. they are pivotable with respect to the consoles 4, 5. The frames 9, 10 are connected to one another in regular crane operation. The main boom 6 is connected to the frame 10 by means of the guying 65. The length of the guying 65 is settable by means of a hoisting winch, whereby the horizontal distance between the lifting hook 64 and the tower 1 can be varied. In this process, the main boom rotates about the supporting point 51 and a luffing movement of the boom 6 takes place. This applies equally to the counter-boom 7 that is connected to the frame 9 by means of the guying 75. The counter-boom 7 is luffed about the supporting point 41 and the horizontal distance between the lifting hook 74 and the tower 1 changes by changing the length of the guying 75 by means of the hoisting winch.

Figure 2:
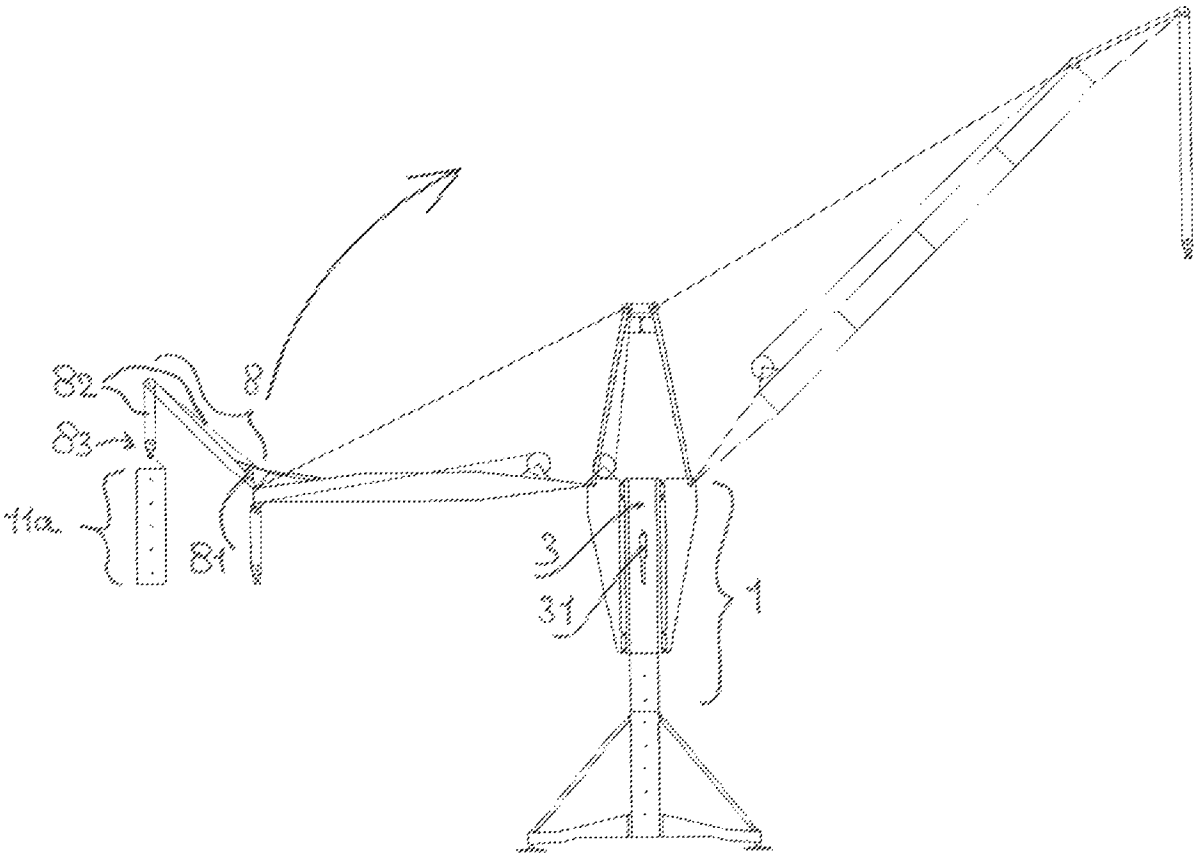
FIGS. 2 to 4: sketched side representations of the crane revolving tower in accordance with the invention during the climbing procedure in chronological order.
Figure 3:
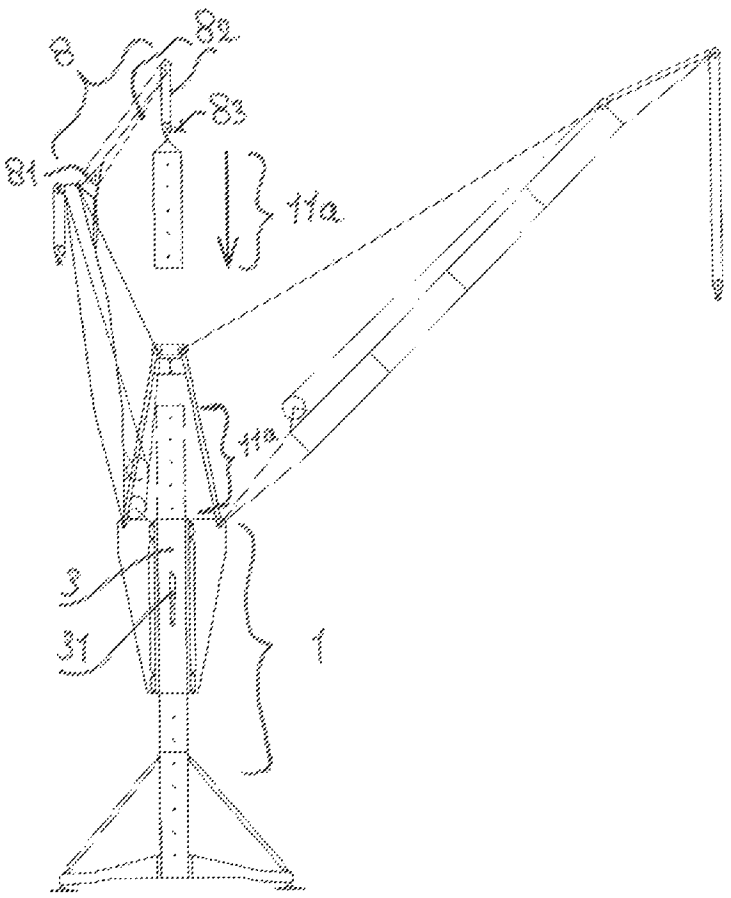
Figure 4:
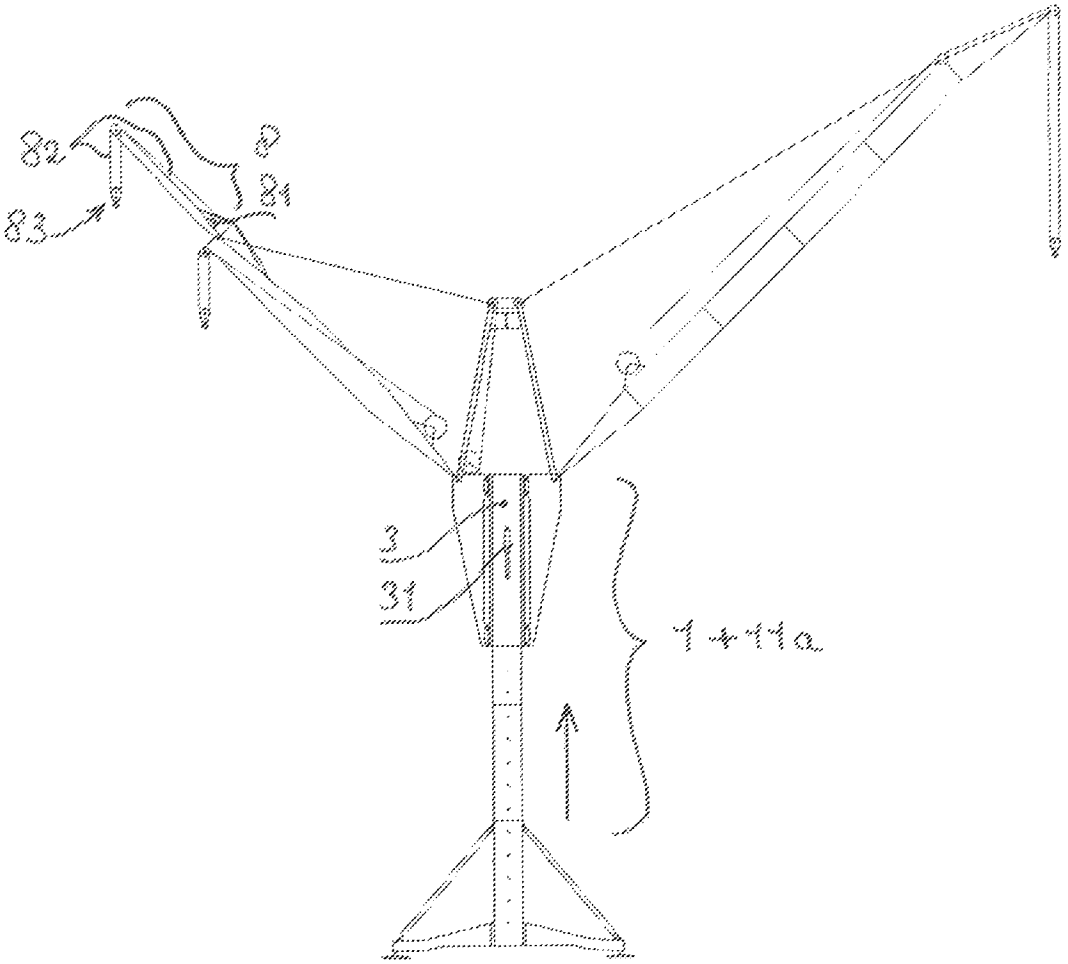

The climbing process (FIGS. 2-4) in which the crane tower 1 is supplemented by one or more tower pieces 11*a* is as follows: A new tower piece 11*a* is raised by the auxiliary boom 8 and the lifting hook 83 (FIG. 2). The distance of the lifting hook 83 from the tower center is reduced by pivoting the counter-boom 7. Since the auxiliary boom 8 is designed in the manner of a portal, the tower piece 11*a* is "rocked" by the auxiliary boom 8 and is positioned above the remaining tower 1 (FIG. 3). The tower piece 11*a* can be installed in the region of the climbing section 3 on the topmost lattice piece of the crane tower 1 by letting out the hoist rope 82 by means of the hoist winch 81 (FIG. 3). The climbing section 3 can subsequently push up the total unit by means of the hydraulic cylinder 31 (FIG. 4).

Figure 5:
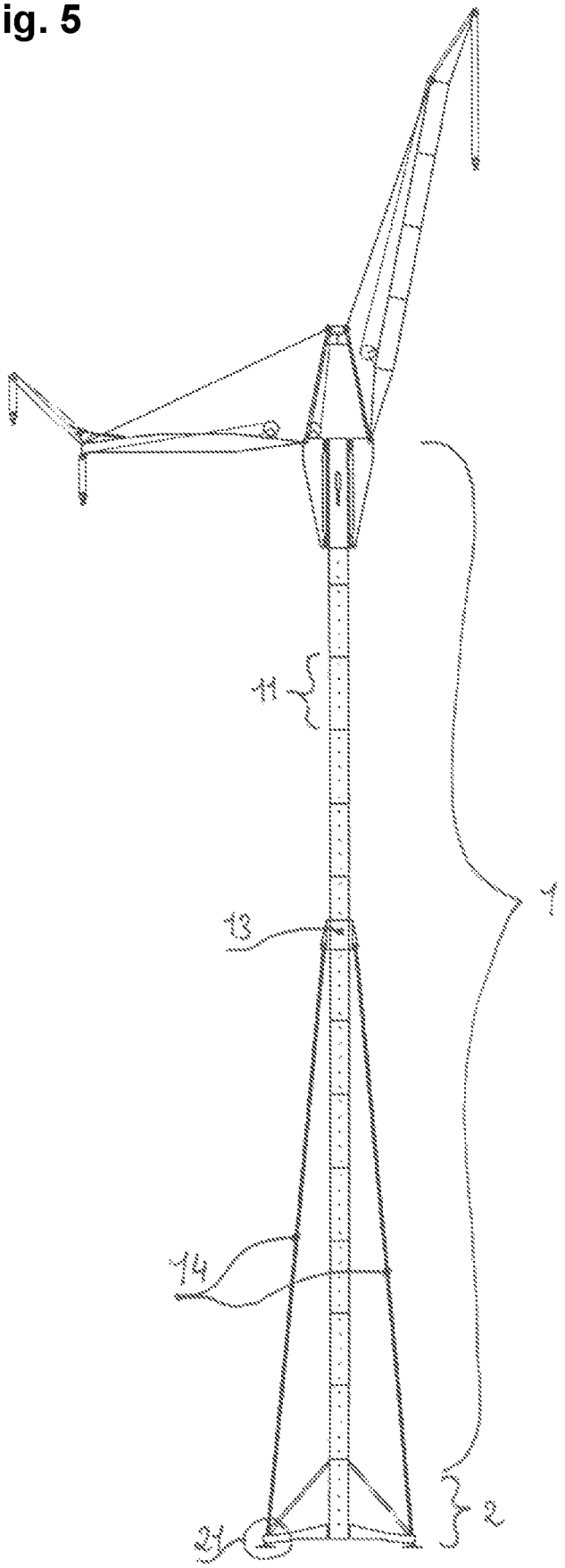
FIG. 5: the crane revolving tower in accordance with the invention with an additional guying of the crane tower.

If the maximum free-standing height of the crane is not sufficient, there is the option of stabilizing the crane, whereby a further extension of the crane tower can be implemented. A collar 13 is installed around the tower 1 for this purpose, as is shown in FIG. 5. A guying 14 is installed between the collar 13 and the base points 21 of the undercarriage 2. The guying 14 normally comprises rope material and sheet metal material and is preloaded. Since the crane is now more stable, the crane can be increased in height with further tower pieces 11.

Figure 6:
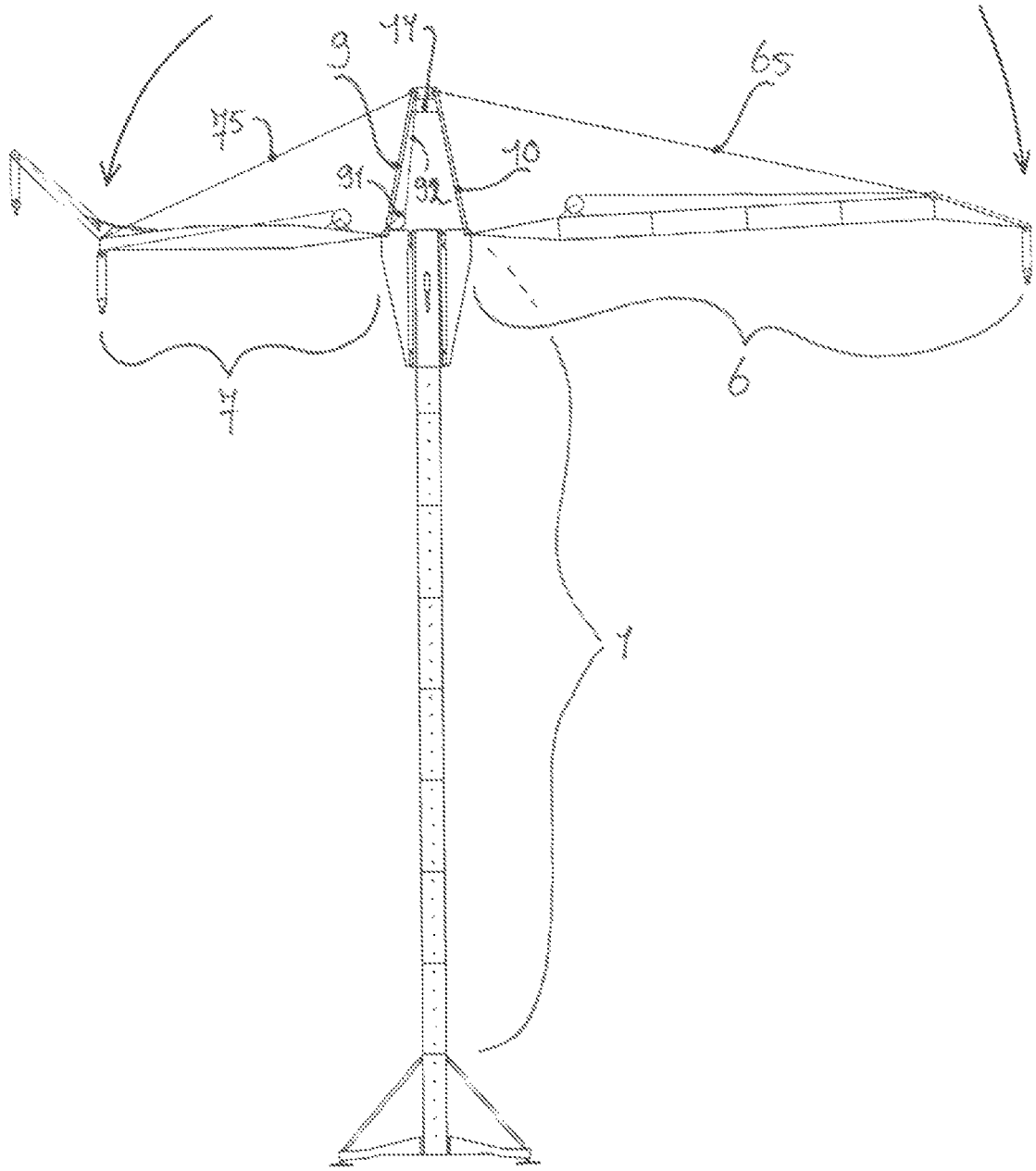
FIGS. 6 and 7: sketched side representations of the crane revolving tower in accordance with the invention during the moving of the boom into the out-of-operation position.
Figure 7:
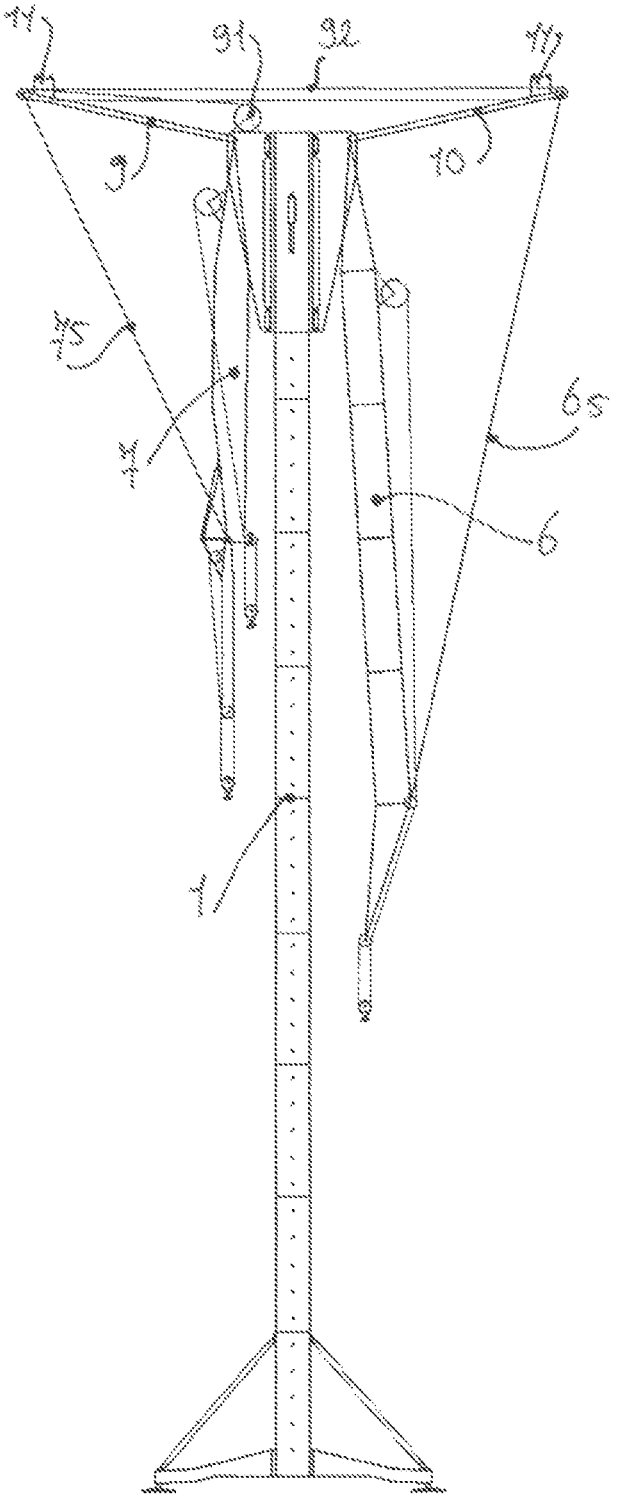

If the crane is to be temporarily taken out of operation, it is moved into a special "out-of-operation position" to reduce the resulting area exposed to wind of the total crane construction as much as possible. The crane can thereby also be left set up at higher wind speeds. For this purpose, the two boom guying systems 65, 75 are first extended to luff the main boom and the counter boom 6, 7 down as flat as possible (see FIG. 6). For static reasons, the booms 6, 7 should adopt a horizontal position. The connection 11 between the frames 9, 10 is then released and the position of the frames 9, 10 and thus the position of the booms 6, 7 are thus changed by a further letting out of the hoist rope 92 by means of the hoist winch 91. The frames 9, 10 move outwardly and the booms 6, 7 are in the "negative" luffing range. The final out-of-operation position is reached when the main boom 6 and the counter-boom 7 have come to lie laterally to and in parallel with the crane tower 1 (see FIG. 7). The total height of the crane is now substantially reduced and the resulting area exposed to wind has been considerably minimized.

The invention claimed is:

1. A tower crane comprising a crane tower composed of a plurality of tower pieces, a main boom arranged at a tower tip, and a counter-boom, wherein at least one main hoist rope is guided over the main boom to take up a load and at least one counter-boom hoist rope is guided over the counter-boom to take up at least one ballast element;

wherein the crane tower comprises at least one climb piece at which the counter-boom and/or the main boom is/are luffably taken up; and wherein one or more consoles are laterally installed at the at least one climb piece, at which consoles the main boom and/or the counter-boom is/are pivotably supported.

2. The tower crane in accordance with claim 1, wherein the at least one ballast element to ballast the counter-boom is taken up via the at least one counter-boom hoist rope.

3. The tower crane in accordance with claim 1, wherein the counter-boom and the main boom are luffably arranged at the tower tip.

4. The tower crane in accordance with claim 1, wherein the at least one climb piece is movable in a vertical direction by means of a hydraulic cylinder, with the hydraulic cylinder being supported at abutments of the crane tower provided for this purpose.

5. The tower crane in accordance with claim 1, wherein one or more drive units and/or switch cabinets and/or hydraulic tanks are installed within at least one of the consoles.

6. The tower crane in accordance with claim 1, wherein at least two guying frames are provided at the at least one climb piece, with at least one guying frame of the at least two guying frames being connected to a guying rope system of the main boom and at least one other guying frame of the at least two guying frames being connected to a guying rope system of the counter-boom, with a respective guying frame being rotatably supported at a console of the lattice piece and with the guying frame of the main boom being supported at the console taking up the main boom and the guying frame of the counter-boom being supported at the console taking up the counter-boom.

7. The tower crane in accordance with claim 6, wherein the guying frames are connected to one another via a length-adjustable connection.

8. The tower crane in accordance with claim 7, wherein the length-adjutable connection is a rope system.

9. The tower crane in accordance with claim 6, wherein the main boom and the counter-boom are downwardly luffable such that the main boom and the counter-boom come to lie laterally at and almost in parallel with the crane tower, by letting out the respective guying rope systems and by extending the rope system connecting the guying frames.

10. The tower crane in accordance with claim 1, wherein the at least one climb piece comprises a pivot bearing to rotate the at least one climb piece about a vertical axis of rotation with respect to the crane tower.

11. The tower crane in accordance with claim 1, wherein at least one auxiliary boom is provided at the counter-boom, with the auxiliary boom being pivotable at a tip of the counter-boom, and with at least one auxiliary hoist rope being guided over the auxiliary boom.

12. The tower crane in accordance with claim 11, wherein the auxiliary hoist rope or a tip of the auxiliary boom is pivotable over the climb piece of the crane tower to introduce one or more lattice pieces into the climb piece that are taken up by means of the auxiliary hoist rope.

13. The tower crane in accordance with claim 11, wherein the auxiliary boom is pivotable with respect to the counter-boom by means of at least one drive.

14. The tower crane in accordance with claim 13, wherein the drive is a hydraulic cylinder.

15. The tower crane in accordance with claim 1, wherein at least one collar is installed or installable about the crane tower; and in that a guying is spanned between any fixing points of a base of the crane or of an undercarriage of the crane and the collar.

16. The tower crane in accordance with claim 15, wherein the guying at least partially comprises rope material and/or sheet metal material.

17. The tower crane in accordance with claim 1, wherein the tower crane is a revolving tower crane.

18. The tower crane in accordance with claim 1, wherein the one or more consoles are installed at a front side and a rear side of the climb piece lying in a luffing plane.

* * * * *